US011108182B2

(12) United States Patent
Zou et al.

(10) Patent No.: US 11,108,182 B2
(45) Date of Patent: Aug. 31, 2021

(54) ELECTRICAL CONNECTOR ASSEMBLY WITH LOCKING ARMS AND LOCKING PLANES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Cheng-Jun Zou, Kunshan (CN); Kuo-Chun Hsu, New Taipei (TW); Bin Peng, Kunshan (CN); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/891,380

(22) Filed: Jun. 3, 2020

(65) Prior Publication Data

US 2020/0381854 A1 Dec. 3, 2020

(30) Foreign Application Priority Data

Jun. 3, 2019 (CN) ..... 201910475844.4

(51) Int. Cl.
*H01R 13/11* (2006.01)
*H01R 13/502* (2006.01)
(Continued)

(52) U.S. Cl.
CPC ..... *H01R 13/11* (2013.01); *H01R 13/428* (2013.01); *H01R 13/502* (2013.01); *H01R 13/641* (2013.01); *H01R 13/642* (2013.01)

(58) Field of Classification Search
CPC ..... H01R 13/641; H01R 13/187; H01R 13/6581; H01R 13/502; H01R 13/11; H01R 13/42
See application file for complete search history.

(56) References Cited

U.S. PATENT DOCUMENTS 7,081,024 B2 * 7/2006 Karadimas ..... H01R 13/6456 439/180
7,927,159 B2 4/2011 Zhang et al.
(Continued)

*Primary Examiner* — Abdullah A Riyami
*Assistant Examiner* — Nader J Alhawamdeh
(74) *Attorney, Agent, or Firm* — Ming Chieh Chang; Wei Te Chung

(57) ABSTRACT

An electrical connector assembly includes a plug connector and a receptacle connector. A plug connector includes an insulative plug housing and a plurality of blade type male contacts retained in the plug housing. Each of the blade type male contacts includes a contacting section composed of two opposite primary mating planes and two opposite side locking planes. Correspondingly, a receptacle connector includes an insulative receptacle housing and a plurality of clip type female contacts retained in the receptacle housing. Each of the clip type female contacts includes a pair of contacting portions sandwiching the two opposite primary mating planes of the corresponding blade type male contact therebetween in a first horizontal direction. A metallic blade type locking piece retained in the receptacle housing, includes a pair of locking arms sandwiching the two opposite side locking planes therebetween in a second horizontal direction perpendicular to the first horizontal direction.

13 Claims, 7 Drawing Sheets

(51) Int. Cl.

| | |
|---|---|
| ***H01R 13/428*** | (2006.01) |
| ***H01R 13/642*** | (2006.01) |
| ***H01R 13/641*** | (2006.01) |

(56) References Cited

U.S. PATENT DOCUMENTS

| | | | | |
|---|---|---|---|---|
| 8,047,861 | B2 * | 11/2011 | Ciriello | H01R 13/5202 439/271 |
| 9,153,887 | B2 * | 10/2015 | Chen | H01R 12/7088 |
| 9,559,467 | B1 * | 1/2017 | Khorrami | H01R 13/187 |
| 10,622,762 | B1 * | 4/2020 | McKee | H01R 13/506 |
| 10,714,854 | B2 * | 7/2020 | Peng | H01R 13/641 |
| 2010/0178788 | A1 * | 7/2010 | Collin | H01R 13/625 439/317 |
| 2015/0258905 | A1 * | 9/2015 | Fukushima | H01R 13/567 439/34 |
| 2017/0194738 | A1 * | 7/2017 | Poncini | H01R 4/029 |
| 2017/0244193 | A1 * | 8/2017 | Kondo | H01R 13/6581 |
| 2019/0237889 | A1 * | 8/2019 | Peng | H01R 13/11 |

* cited by examiner

ELECTRICAL CONNECTOR ASSEMBLY WITH LOCKING ARMS AND LOCKING PLANES

BACKGROUND OF THE INVENTION

1. Field of the Invention

The present invention relates generally to an electrical connector assembly, and particularly to the electrical connector assembly having the mated plug and receptacle connectors wherein the blade type male contact of the plug connector is surrounded and sandwiched by the paired female contacts of the receptacle connector.

2. Description of Related Arts

U.S. Patent Application Publication No. US 2019/0237889 discloses the mated male connector and female connector. The retention between the male contact and the female contact is deemed insufficient during severe vibration.

It is desired to provide more retention forces upon the blade type male contact of the plug connector by the clip type female contact of the receptacle connector.

SUMMARY OF THE INVENTION

To achieve the above object, an electrical connector assembly includes a plug connector and a receptacle connector mated with each other. The plug connector includes an insulative plug housing and a plurality of blade type male contacts retained in the plug housing. Each of the blade type male contacts includes a contacting section composed of two opposite primary mating planes and two opposite side locking planes. Correspondingly, the receptacle connector includes an insulative receptacle housing and a plurality of clip type female contacts retained in the receptacle housing. Each of the clip type female contacts includes a pair of contacting portions sandwiching the two opposite primary mating planes of the corresponding blade type male contact therebetween in a first horizontal direction. A metallic blade type locking piece retained in the receptacle housing, includes a pair of locking arms sandwiching the two opposite side locking planes therebetween in a second horizontal direction perpendicular to the first horizontal direction.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
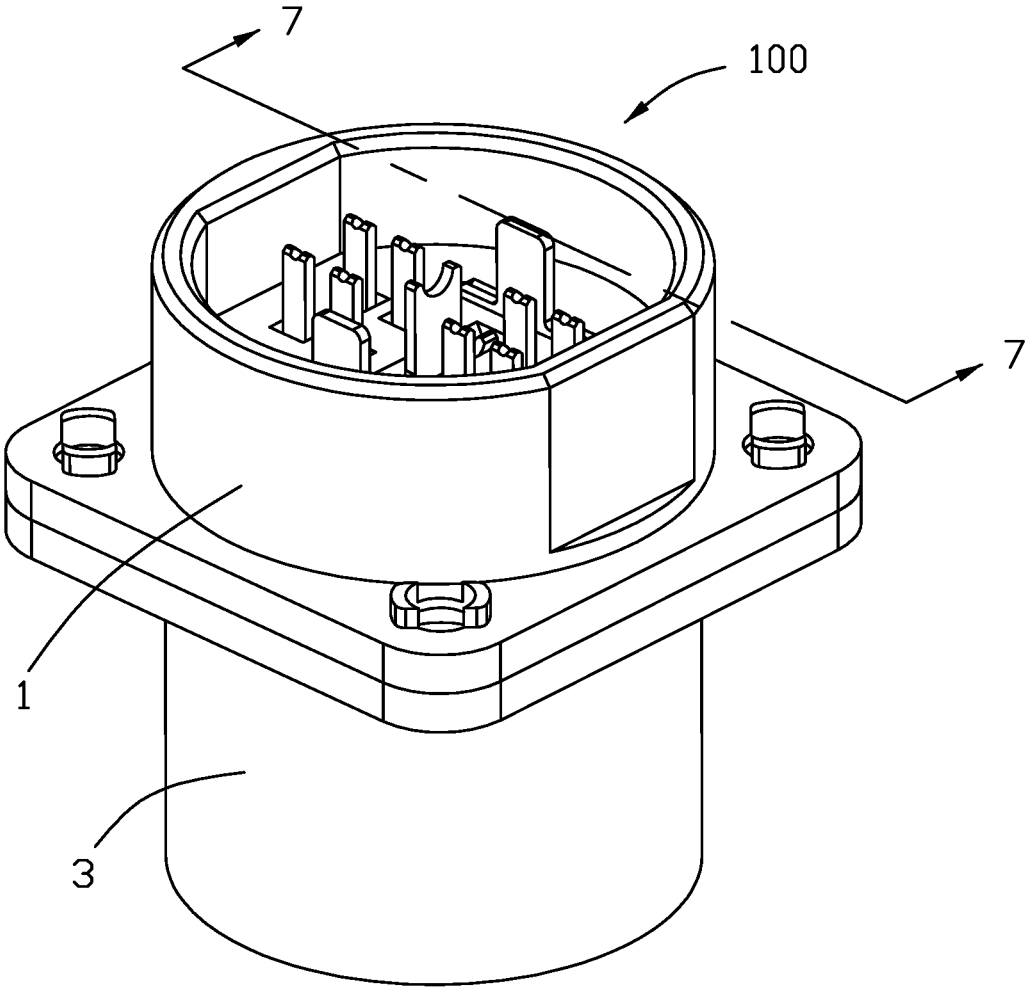
FIG. 1 is a perspective view of the electrical connector assembly according to the present invention.
Figure 2:
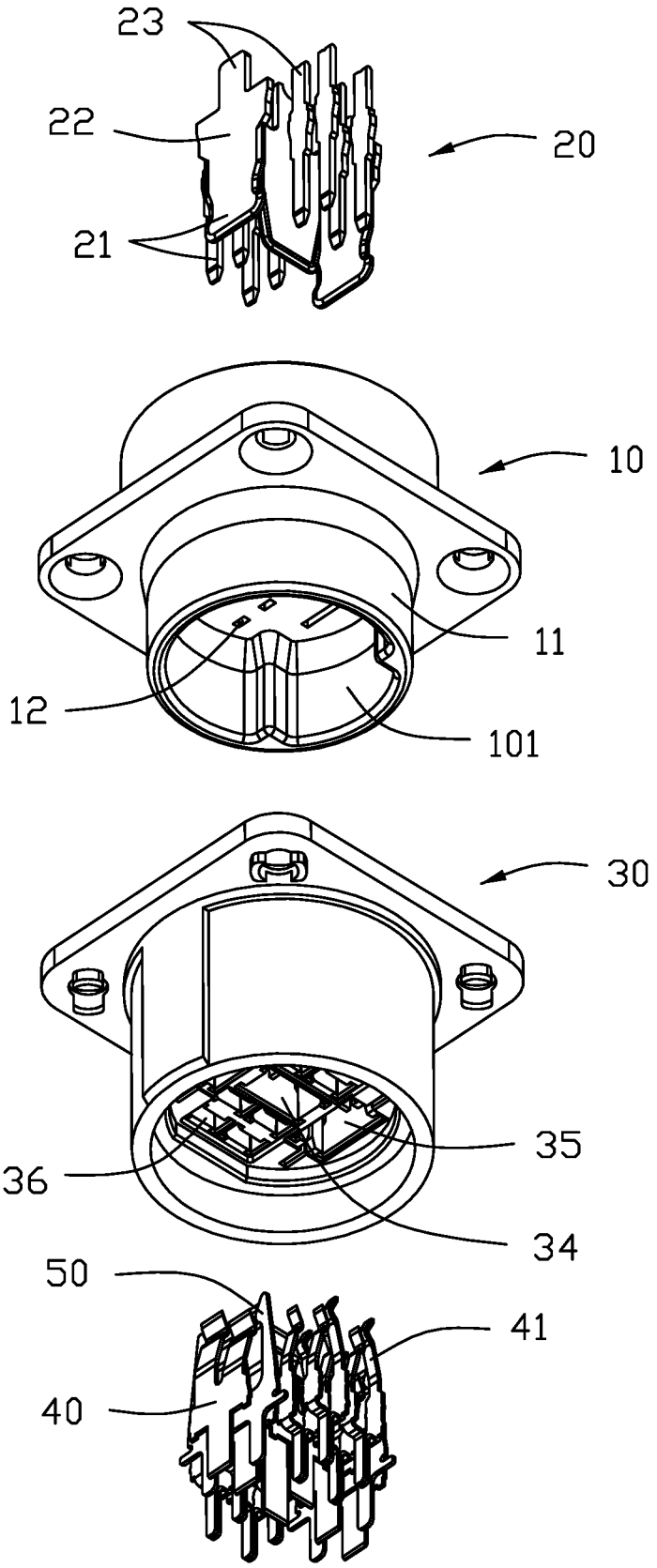
FIG. 2 is an exploded perspective view of the electrical connector assembly of FIG. 1.
Figure 3:
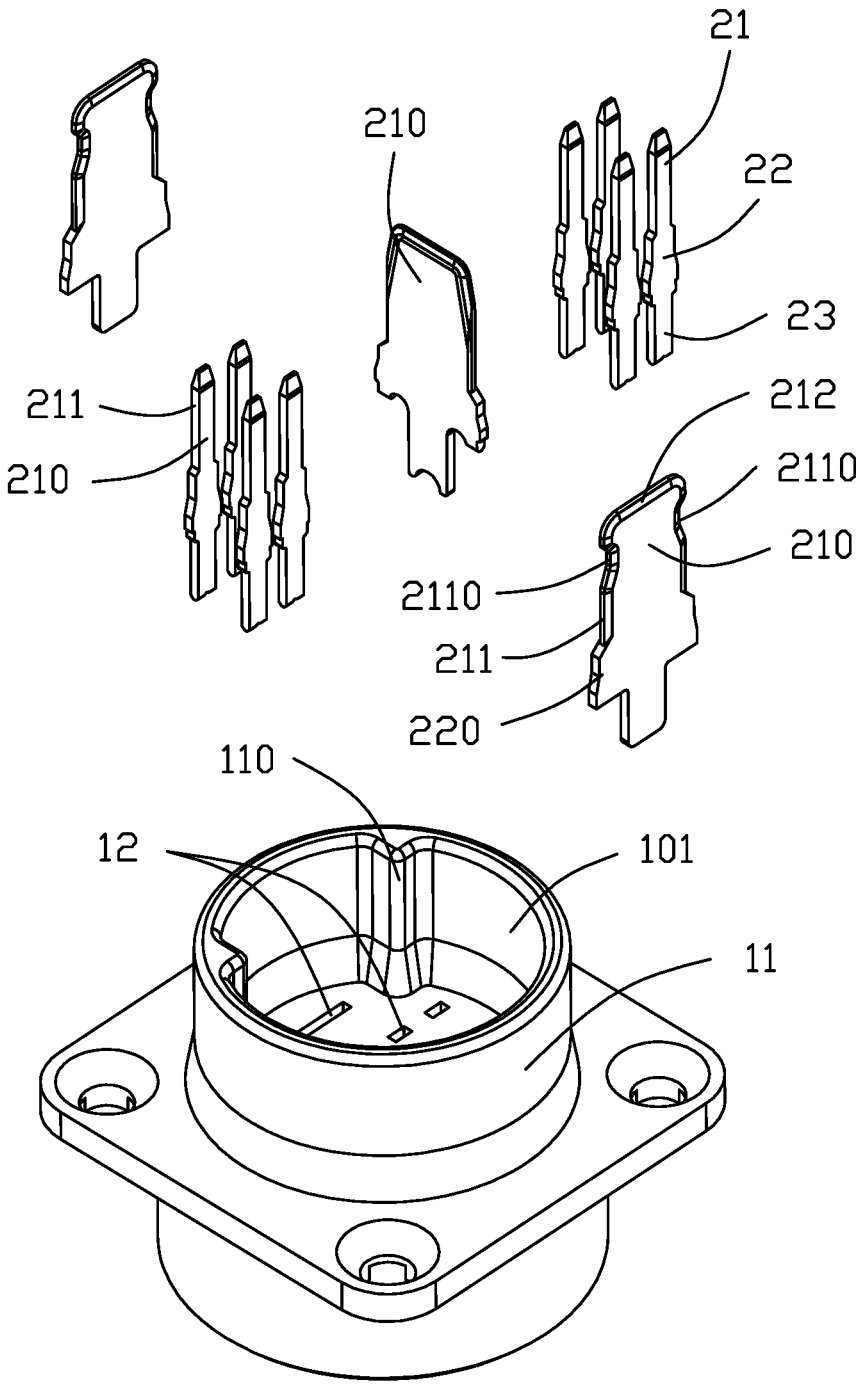
FIG. 3 is an exploded perspective view of the plug connector of the electrical connector assembly of FIG. 2.
Figure 4:
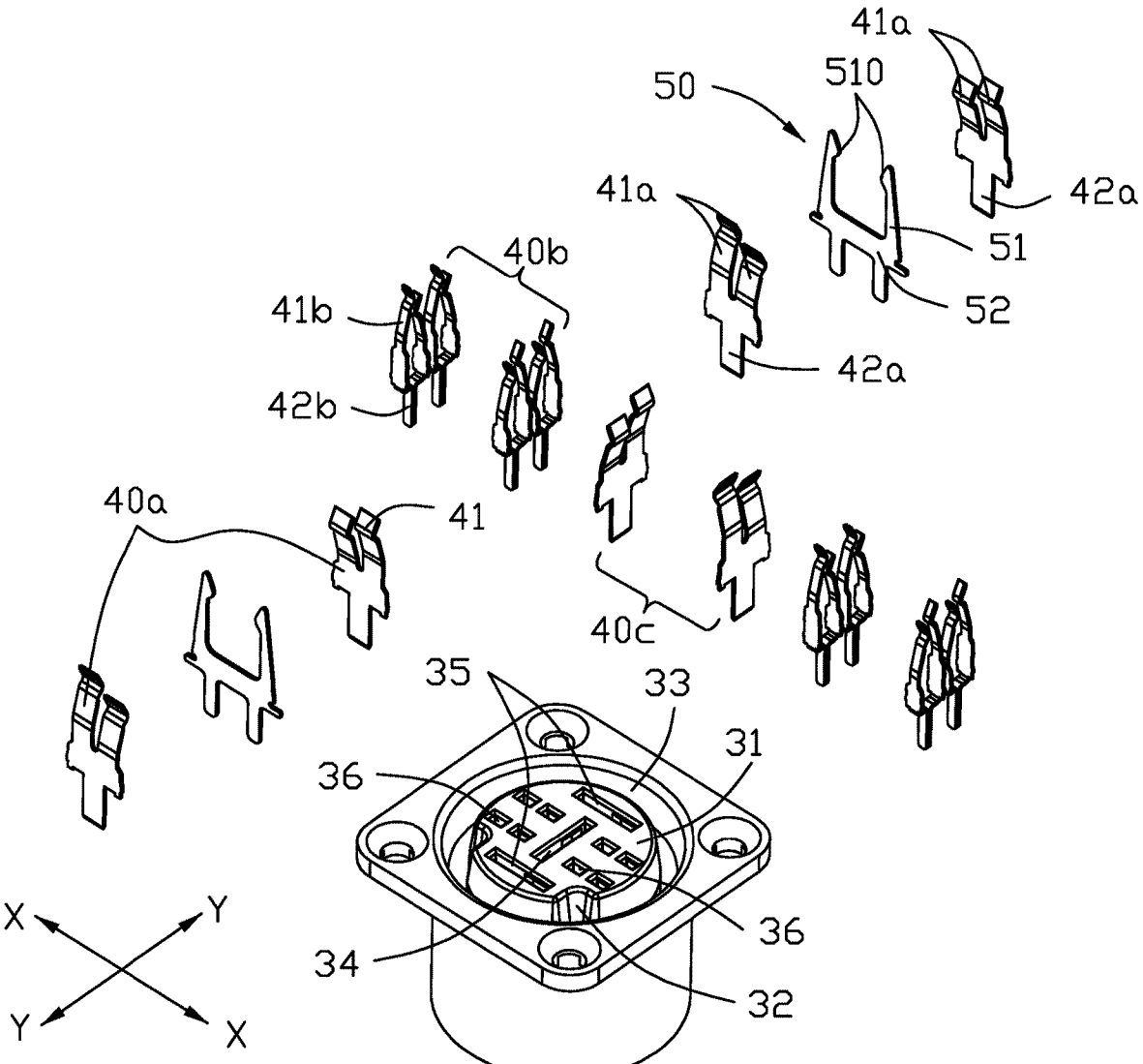
FIG. 4 is an exploded perspective view of the receptacle connector of the electrical connector assembly of FIG. 2.
Figure 5:
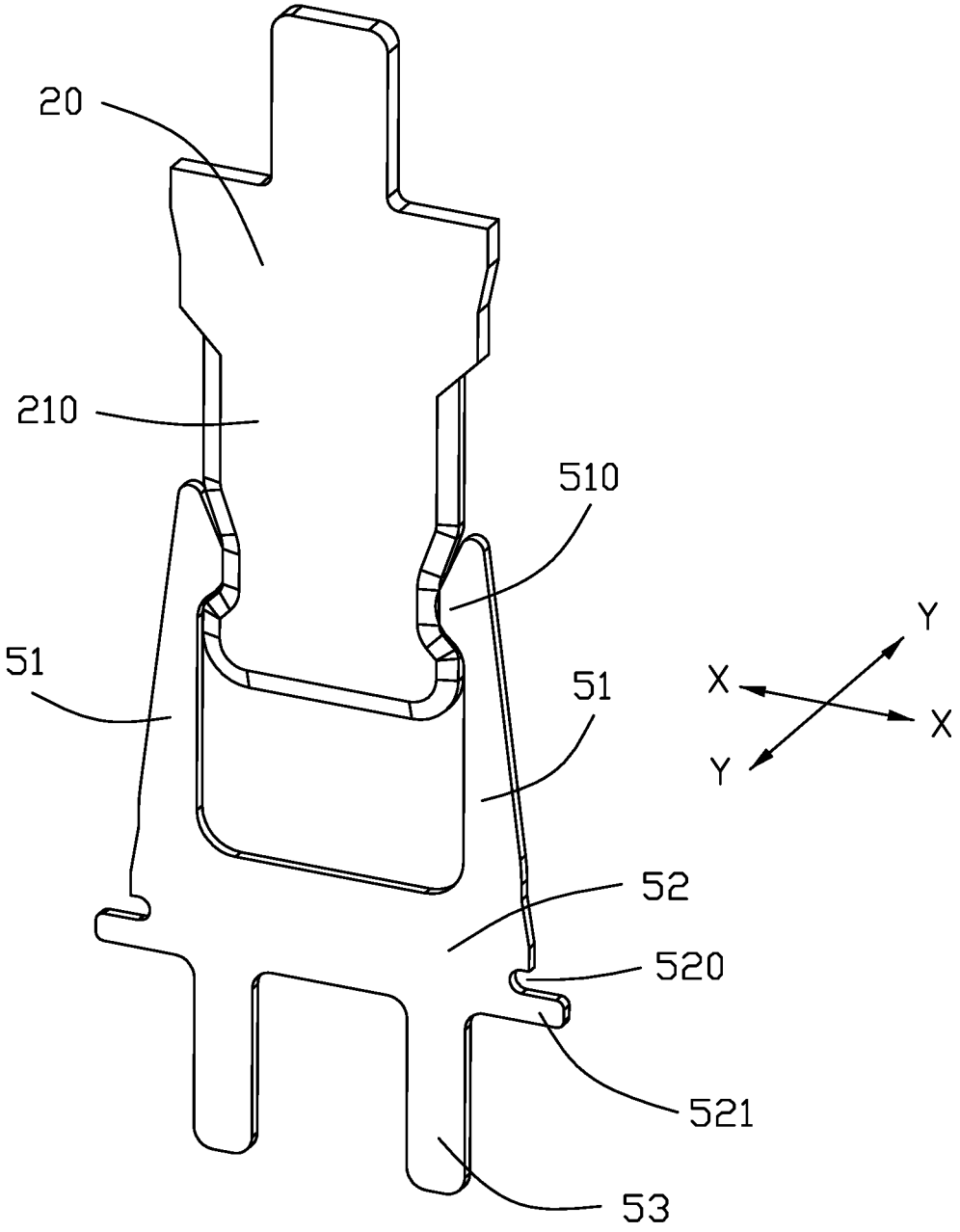
FIG. 5 is a perspective view of the male contact of the plug connector and the locking piece of the receptacle connector of the electrical connector assembly of FIG. 1, which are engaged with each other.
Figure 6:
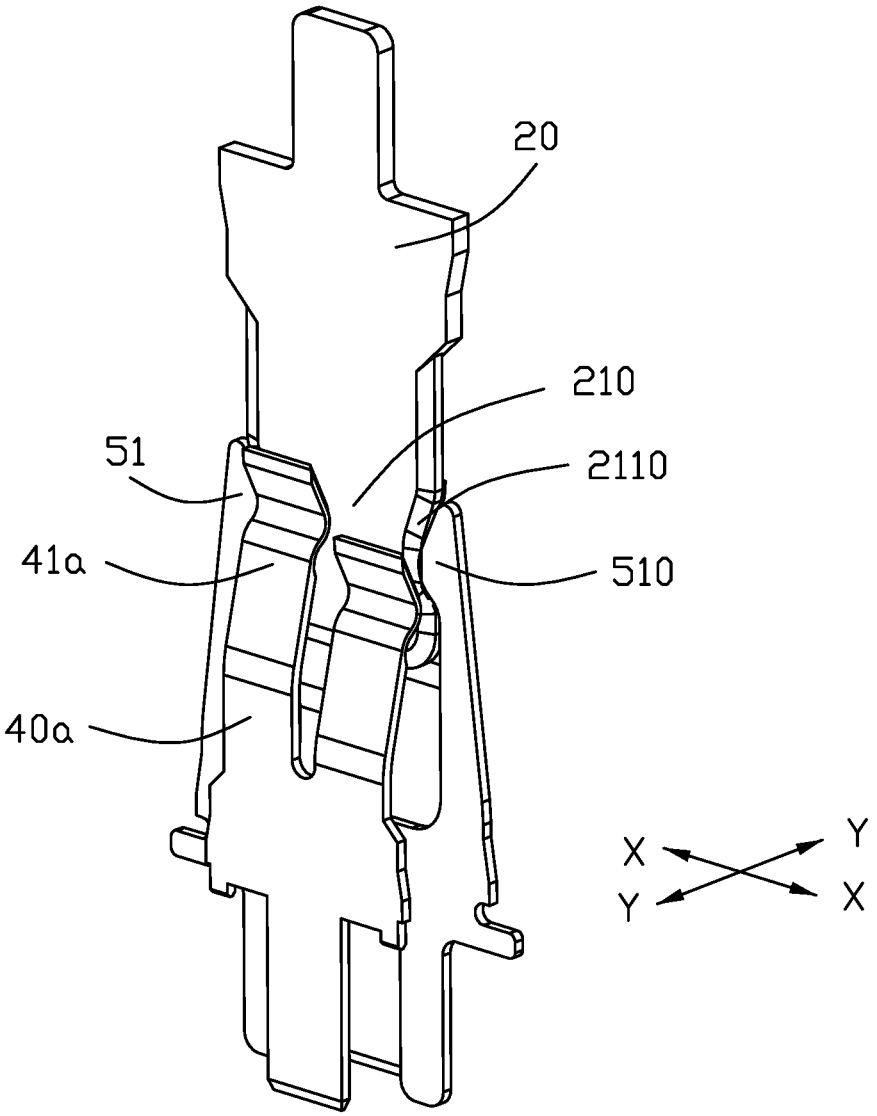
FIG. 6 is a perspective view of the male contact of the plug connector and the locking piece of the receptacle connector of the electrical connector assembly of FIG. 5 with the associated female contacts.
Figure 7:
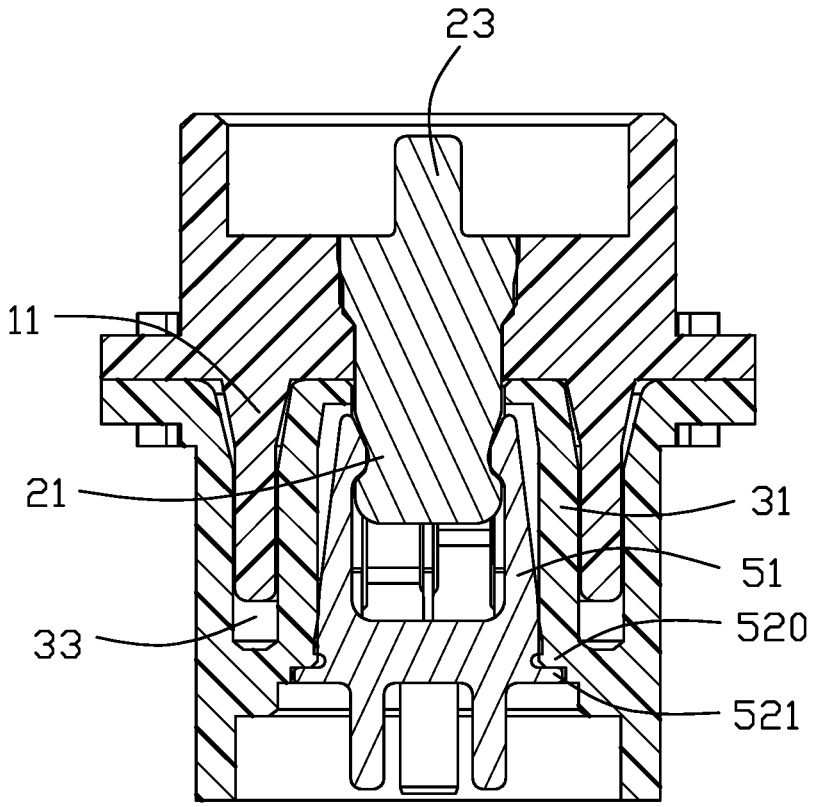
FIG. 7 is a cross-sectional view of the electrical connector assembly of FIG. 1 along line 7-7.

Referring to FIGS. 1-7, an electrical connector assembly 100 includes a plug connector 1 and a receptacle connector 3 adapted to be mated with each other. The plug connector 1 includes an insulative plug housing 10 and a plurality of male contacts 20 retained in the plug housing 10. The plug housing 10 forms a mating cavity 101 in a round mating section 11. An alignment rib 110 is formed on the mating section 11 in the mating cavity 101. A plurality of passageways 12 are formed in the plug housing 10.

The male contact 20 is retained in the passageway 12 and includes a contacting section 21 extending into the mating cavity 101, a retaining section 22 retained to the plug housing 10, and a soldering section 23 exposed outside of the plug housing 10. The contacting section 21 of each large male contact 20, includes two opposite primary mating planes 210, and two opposite side locking planes 211. In detail, a pair of locking notches 2110 are formed in the corresponding side locking planes 211. The contacting section 21 includes a front end region 212 where the locking notches 2110 are close to. The retaining section 22 forms barbs 220 for retention.

The receptacle connector 3 includes an insulative receptacle housing 30 and a plurality of female contacts 40, and a plurality of locking pieces 50. The insulative receptacle housing 31 includes a columnar mating portion 31 surrounded by a ring type mating space 33 and equipped with a pair of alignment grooves 32 therein. During mating, the mating section 11 of the plug connector 1 is received within the mating space 33 of the receptacle connector 3 while the mating portion 31 of the receptacle connector 3 is received within the mating cavity 101 of the plug connector 1. The alignment ribs 110 are received within the corresponding alignment grooves 32.

The insulative receptacle housing 30 forms a plurality of passageways 34, 35 and 36. The locking piece 50 includes a pair of locking arms 51 extending into the corresponding passageway 35. Each locking arm 51 forms a locking head 510 to be received within the corresponding locking notch 2110. Some female contacts 40*a* are paired to include a pair of contacting arms 41*a* extending into the corresponding passageway 35 toward each other in direction Y while the locking arms 51 extend toward each other in direction X. The locking piece 50 further includes a base 52 from which the pair of locking arms 51 upwardly extend and a pair of soldering tabs 52 downwardly extend. A pair of securing tabs 521 are formed at two opposite ends of the base 52 for retention. Notably, the contacting arms 41 are located between the pair of locking arms 51 in direction Y when viewed along direction X. During mating, the contacting arms 41*a* commonly sandwich the primary mating planes 210 in direction X while the locking arms 51 commonly sandwich the locking planes 211 in direction Y wherein the locking heads 510 are engaged within the corresponding locking notches 2110.

In a top view, the passageway 34 spans in direction Y, the passageway 35 spans in direction X, and the passageway 36 spans in direction X. The locking piece 50 is associated with the corresponding passageway 35. Each passageway 34 is equipped with a pair of contacts 40*c*. Each passageway 35 is equipped with a pair of contacts 40*a*. The passageway 36 is equipped with a pair of contacts 40*b*. Each contact 40*a* includes two contacting arms 41*a* and one soldering tail 42*a*. Understandably, the soldering tails 42*a* of the pair of contacts 40*a* are soldered to the same wires (not shown). The contact 40*b* includes a pair of contacting arms 41*b* commonly sandwiching the corresponding male contact therebetween, and a pair of soldering tails 42*b* are intimately attached to each other. During mating, the pair of female contacts 40*a* commonly sandwich the male contacts 20 in direction Y to form the positive electrode. At the same time, the pair of locking pieces 50 commonly sandwich the same male contact 20 in direction X. The contact 40*c* forms the negative electrode.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

a plug connector and a receptacle connector adapted to be mated with each other in a vertical direction;

the plug connector including:

an insulative plug housing and a plurality of male contacts retained therein, each of said male contacts being of a blade type and defining two opposite primary mating planes and two opposite side locking planes;

the receptacle connector including:

an insulative receptacle housing with a plurality of female contacts and locking pieces retained therein, said female contacts being paired and each pair of female contacts including a pair of resilient contacting arms, and each locking piece including a pair of locking arms; wherein during mating, the pair of resilient contacting arms commonly sandwich the corresponding two opposite primary mating planes in a first horizontal direction perpendicular to the vertical direction, and the pair of locking arms commonly sandwich the corresponding two side locking planes in a second horizontal direction in a second horizontal direction perpendicular to both the vertical direction and the first horizontal direction.

2. The electrical connector assembly as claimed in claim 1, wherein the locking piece forms a blade construction.

3. The electrical connector assembly as claimed in claim 2, wherein both the male contact and the locking piece extend in a plane defined by the vertical direction and the second horizontal direction.

4. The electrical connector assembly as claimed in claim 1, wherein a pair of locking notches are formed in the corresponding locking planes, respectively.

5. The electrical connector assembly as claimed in claim 4, wherein each of the locking arms forms a locking head at a free end.

6. The electrical connector assembly as claimed in claim 1, wherein viewed along the first horizontal direction, the contacting arms are located between the pair of locking arms in the second horizontal direction.

7. The electrical connector assembly as claimed in claim 1, wherein viewed along the second horizontal direction, the locking arms are located between the pair of contacting arms in the first horizontal direction.

8. An electrical receptacle connector for mating, along a vertical direction, with a plug connector having corresponding blade type contacts therein, comprising:

an insulative receptacle housing with a plurality of female contacts and locking pieces retained therein, said female contacts being paired and each pair of female contacts including a pair of resilient contacting arms, and each locking piece including a pair of locking arms; wherein the receptacle housing includes a plurality of passageways each being equipped with one pair of female contacts and one locking piece; wherein in each passageway, the pair of corresponding contacting arms are opposite to each other in a first direction perpendicular to the vertical direction, and the pair of corresponding locking arms are opposite to each other in a second direction perpendicular to both the vertical direction and the first horizontal direction.

9. The electrical receptacle connector as claimed in claim 8, wherein the locking piece includes a base extending in the second horizontal direction, and the pair of locking arms extend upwardly therefrom in the vertical direction.

10. The electrical receptacle connector as claimed in claim 9, wherein the locking piece further includes a pair of soldering tabs downwardly extending from the base in the vertical direction.

11. The electrical receptacle connector as claimed in claim 9, wherein the locking piece further includes a pair of securing tabs extending opposite away from each other from two opposite ends of the base in the second horizontal direction.

12. An electrical plug connector for mating, along a vertical direction, with a receptacle connector having a plurality of passageways with a plurality of paired female contacts and locking pieces therein, respectively, comprising:

an insulative plug housing;

a plurality of blade type male contacts retained in the plug housing and adapted to be inserted into the corresponding passageways respectively, each of said male contacts forms a pair of primary mating planes opposite to each other in a first horizontal direction perpendicular to the vertical direction, and a pair of side locking planes opposite to each other in a second horizontal direction perpendicular to both the vertical direction and the first horizontal direction; wherein a pair of locking notches are formed in the corresponding locking planes, respectively.

13. The electrical plug connector as claimed in claim 12, wherein the locking notches are positioned adjacent to a free end of the male contact in the vertical direction.

* * * * *